United States Patent [19]

Niznik

[11] Patent Number: 4,844,448

[45] Date of Patent: Jul. 4, 1989

[54] STAND UP EXERCISER

[76] Inventor: Michael D. Niznik, 11314 Bonanza La. #1, St. Louis County, Mo. 63074

[21] Appl. No.: 167,366

[22] Filed: Mar. 14, 1988

Related U.S. Application Data

[63] Continuation-in-part of Ser. No. 92,407, Sep. 2, 1987, abandoned.

[51] Int. Cl.[4] ..... A63B 1/02; A63B 21/00

[52] U.S. Cl. ..... 272/62; 272/136; 272/140; 272/900

[58] Field of Search ..... 272/62, 112, 116, 130, 272/135, 136, 140, 142, 900; 297/274, 275

[56] References Cited

U.S. PATENT DOCUMENTS

| | | | |
|---|---|---|---|
| 1,430,573 | 10/1922 | Lindstrom et al. | 272/62 |
| 2,261,172 | 11/1941 | Maxwell | 272/83 |
| 2,425,971 | 8/1947 | Walker | 272/57 |
| 2,959,414 | 11/1960 | Saltz | 272/83 |
| 3,716,232 | 2/1973 | Johnson et al. | 272/63 |
| 3,904,198 | 9/1975 | Jones | 272/123 |
| 4,109,907 | 8/1978 | Zito | 272/117 |
| 4,241,914 | 12/1980 | Bushnell | 272/136 |
| 4,275,882 | 6/1981 | Grosser et al. | 272/117 |
| 4,293,127 | 10/1981 | Dudley | 272/900 X |
| 4,529,191 | 7/1985 | Miller et al. | 272/62 |
| 4,618,140 | 10/1986 | Brown | 272/130 |

FOREIGN PATENT DOCUMENTS

| | | | |
|---|---|---|---|
| 178222 | 7/1917 | Canada | 297/274 |
| 2569349 | 2/1986 | France | 272/130 |
| 604340 | 3/1960 | Italy | 272/142 |

*Primary Examiner*—Richard J. Apley
*Assistant Examiner*—Franklin L. Gubernick
*Attorney, Agent, or Firm*—Graveley, Lieder & Woodruff

[57] ABSTRACT

A home basic body exercise device having a clamp for engaging the walls of adjacent rooms above a doorway with a depending frame pivotally connected to the clamp at one end beneath the doorway and having a bar with a rotatable padded cover at the other end. High tension spring means connect the clamp to the frame intermediate its ends. The device is used to exercise all body areas from a basic standing position acting against the resistance of the spring.

7 Claims, 1 Drawing Sheet

STAND UP EXERCISER

REFERENCE TO PRIOR APPLICATION

This application is a continuation-in-part of Ser. No. 092,407 filed Sept. 2, 1987 entitled STAND UP EXERCISER, now abandoned.

BACKGROUND OF THE INVENTION

This invention relates to exercise devices and in particular relates to portable exercise devices which can be installed above a door jamb frame in a room of a house against the wall structure and can be readily removed.

One of the principal objects of this invention is to provide an exerciser in which all parts of the body can be exercised with the user in a stand up position.

Another principal object is to provide a portable exercise device which can be positioned in the doorway of a room whether or not there is a frame around the doorway and which will allow all body areas to be exercised in a stand up position. A further object is to provide a stand up exerciser which will provide the same exercise advantages as sit-ups and leg lifts.

Still another object of this invention is to provide an adjustable stand up exerciser which will compensate for differences in heights of different users.

These and other objects and advantages will become apparent hereinafter.

The present invention comprises a portable stand up exerciser which is attachable to the walls of a house above a doorway and which allows all parts of the body to be exercised from a stand up position, including those areas conventionally exercised by sit-ups and leg lifts.

The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
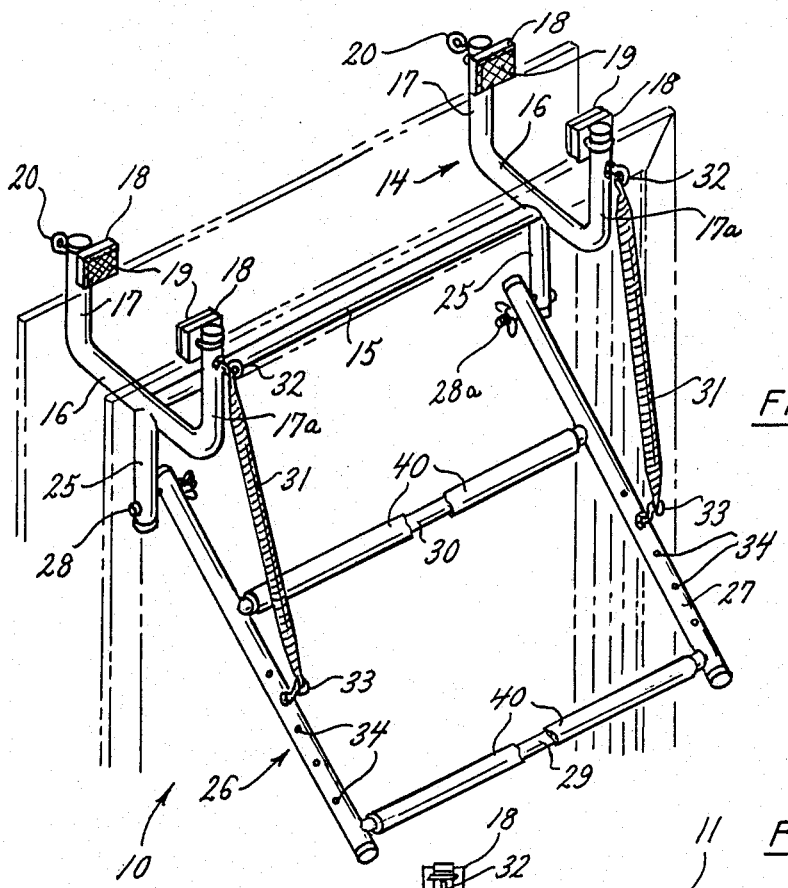
FIG. 1 is a fragmentary perspective view showing the exerciser mounted in a household doorway.
Figure 2:
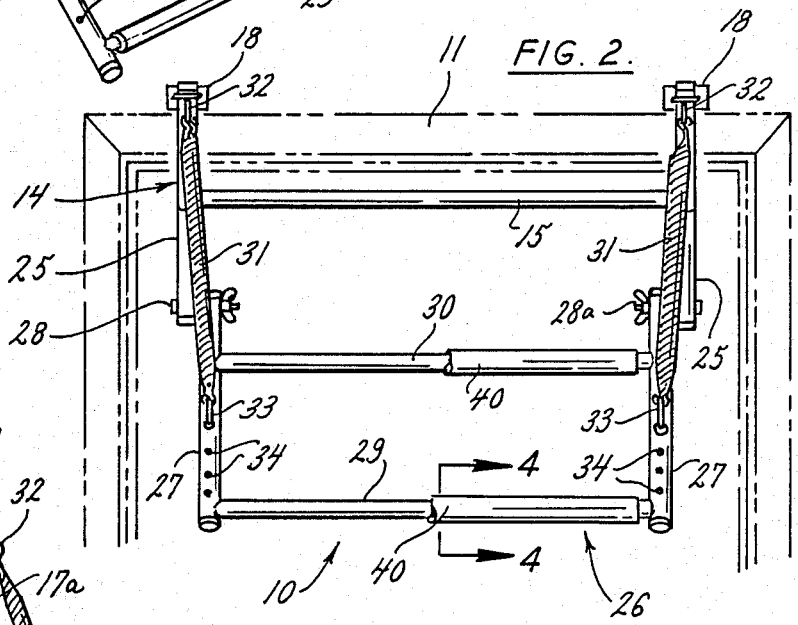
FIG. 2 is a front elevational view.
Figure 3:
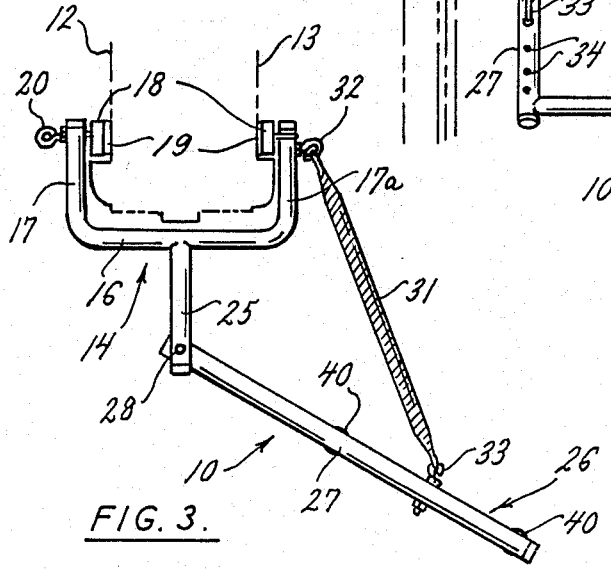
FIG. 3 is a side elevational view.
Figure 4:
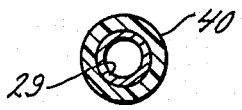
FIG. 4 is a sectional view taken along line 4—4 of FIG. 2.

FIGS. 2 & 3 show the stand up exerciser 10 mounted above a door frame 11 against the opposed walls 12 and 13 of adjacent rooms. The mounting portion of the exerciser 10 comprises a clamp structure 14 which includes a stabilizer bar 15 which connects U-shaped clamp elements 16. Each of the U-shaped elements 16 have opposed arms 17 and **17*a* which fit against walls 12 and 13** of adjoining rooms.

Positioned inwardly of the arms 17 and **17*a* are adjustable clamp blocks 18 which are faced with a durable foam rubber or resilient polymer pads 19. The pads 19 grip the wall surfaces 12 and 13 and are designed to create a suction or friction so that they retain the exerciser 10 to the walls 12 and 13 when the exerciser 10 is in use. Adjustment means 20, such as the illustrated eye bolt adjusting rods, move the blocks 18 toward and away from the walls 12 and 13**.

If there is a door frame 11 around the doorway, the clamps 18 are positioned above the frame 11 and bear directly against the room walls 12 and 13. Thus the frame 11 does not bear any load when the exerciser 10 is in use and the exerciser 10 can be installed even when there is no frame 11 around a door opening.

In opposed direction from the arms 17 are depending swing connectors 25 which are connected to the bight portion of the clamp structure 14 and are generally aligned with the stabilizer bar 15.

Rotatably fixed adjacent to the ends of the connectors 25 is a swing 26. The swing 26 consists of opposed side members 27 which have free ends which are rotatably connected to the swing connectors at 28 and **28*a* and spaced grip bars 29 and 30 which connect and separate the side frame members 27**.

Connecting the swing 26 and the upstanding clamp arms **17*a* are resilient means 31 which are illustrated as springs. The springs 31 are fixed at one end 32 to the arms 17*a* and are adjustably fixed to the side bars 27 at their other ends 33. The side frames 27 are provided with a series of spaced openings 34 so that the position of the grip bars 29 and 30 can be raised or lowered, depending on the height of the user. The springs 31** preferably are about 40 ft pounds.

Positioned around the grip bars 29 and 30 are grips 40 which are designed to rotate around the bars 29 and 30 to provide a comfortable grip for the user and to avoid strain and binding of the wrist of the user when pressure is applied to the bars 29 and 30. The grips 40 are of a durable foam rubber or polymer tubing.

OPERATION

The present invention operates on one main theory, namely that of spring tension reistance applied to a down swinging motion which causes muscle tissue to stretch, thereby creating a body toning exercise. All exercises are performed in the stand up, stand up/lean and stand up/squat positions. There is no need to lay on a lift bench or on the floor or to place the user's body in awkward positions. This invention is designed as a basic body exerciser for general upper and lower body exercise, and not for specific or individual muscle toning.

To begin any exercise, one stands straight up, stomach in, chest out and with fully extended arms, takes hold of the bottom grip bar 29.

To exercise the arms, chest and shoulders, the bottom grip bar 29 is pulled down in front of the neck of the user. This is repeated according to a predetermined pattern, usually 10 repetitions.

To exercise the stomach, waist, lower back, and upper body, the user grips the bar 29, places one foot forward and swings the bar 29 down through the doorway bending his waist. This is repeated with the opposite foot forward. This replaces sit-ups in exercise for the stomach.

To exercise the upper back and shoulders, the user grips the bar 29 and pulls down in back of the neck.

To exercise the wrists, the user pulls the bar 29 down until it is even with his chest. Then he moves it up and down using only his wrists as a pivot point.

To exercise the neck and face, the user places the bar 29 under his chin. He then moves the bar 29 up and down using only the chin.

To exercise the arms, chest and shoulders, the user steps back through the doorway and grips the top grip bar 30 with the palms up. He pulls the bar 30 down under his neck. This exercise is repeated after reversing the hands so that they grip the bar 30 with the palms down.

To exercise the front legs and the knees, the bottom bar 29 is gripped and placed in front of the user's neck. Maintaining this position, the user then lowers his body into a squat position. This is repeated for the desired number of repetitions.

To exercise the legs, buttocks and knees, the bottom bar 29 is gripped and placed behind the neck. The user then lowers his body into the squat position and repeats this procedure as often as the schedule calls for.

The last two described exercises replace conventional leg lifts.

To exercise the calves and feet, the user pulls the bar 29 behind his back and lifts his heels from the floor to a tip toe position and repeats for a predetermined time.

This invention is intended to cover all changes and modifications of the example of the invention herein chosen for purposes of the disclosure which do not constitute departures from the spirit and scope of the invention.

What is claimed is:

1. An exercise device for exercising all body areas in a stand-up position, said device being positionable in a doorway comprising:

(a) retaining means for positioning the exercise device in a fixed position between opposed walls in a doorway, said retaining means including opposed members having means for frictionally engaging said opposed walls above the doorway independently of a door frame, (b) depending means pivotally connected to the retaining means and having means to accommodate the hands of a user, and (c) tensioned resilient means urging the depending means toward the retaining means to provide a resistance to pivotal movement of said depending means.

2. The device of claim 1 wherein the retaining means includes U-shaped members having upwardly faced openings, means rigidly connecting and spacing the U-shaped members, opposed means on the U-shaped members for frictionally engaging said opposed walls above the doorway independently of the door frame, and adjustment means for moving the friction means toward and away from at least one of the walls.

3. The device of claim 2 wherein the depending means includes side bars connected adjacent to one end by a cross bar and pivotally mounted on the retaining means at the other end.

4. The device of claim 3 including a cross bar connecting the side bars intermediate the end bar and the free ends.

5. A stand up exercise device for suspending in a houshold doorway comprising:

(a) retaining means for positioning the exercise device in a fixed position between opposed walls in a household doorway, (b) depending means pivotally connected to the retaining means, said depending means including side bars connected adjacent to one end by a cross bar and pivotally mounted on the retaining means at the other end, (c) a rotatable grip member surrounding the end cross bar adapted to be engaged by the hands of a user and rotatable about said end cross bar, and (d) tensioned resilient means urging the depending means toward the retaining means to provide a resistance to pivotal movement of said depending means.

6. A stand up exercise device for suspending in a household doorway comprising:

(a) retaining means for positioning the exercise device in a fixed position between opposed walls in a household doorway, said retaining means comprising spaced U-shaped members adapted to frictionally engage the opposed walls above the doorway opening, (b) depending means pivotally connected to the retaining means and having means to accommodate the hands of the user, and said depending means including side bars connected adjacent to one end by a cross bar and pivotally mounted on the retaining means at the other end, and (c) tensioned resilient means urging the depending means toward the retaining means to provide a resistance to pivotal movement of said depending means, the resilient means being connected between each of the side bars and each of said U-shaped retaining members.

7. The device of claim 6 wherein the resilient means is adjustably positioned along the length of the side bars to accommodate persons of different height.

* * * * *